United States Patent [19]

Rohrer

[11] 4,274,347

[45] Jun. 23, 1981

[54] APPARATUS FOR SEWING SLIDE FASTENER CHAIN TO ARTICLE PANELS

[75] Inventor: Robert L. Rohrer, Meadville, Pa.

[73] Assignee: Textron, Inc., Providence, R.I.

[21] Appl. No.: 179,199

[22] Filed: Aug. 18, 1980

[51] Int. Cl.[3] ..... D05B 3/12; D05B 29/00; D05B 27/10

[52] U.S. Cl. ..... 112/104; 112/152; 112/235; 112/322

[58] Field of Search ..... 112/104, 152, 235, 322, 112/318, 265.2

[56] References Cited

U.S. PATENT DOCUMENTS

| | | | |
|---|---|---|---|
| 3,016,028 | 1/1962 | Schreck et al. | 112/322 X |
| 3,026,833 | 3/1962 | Schreck et al. | 112/322 |
| 3,318,273 | 5/1967 | Eddy | 112/235 |
| 3,680,510 | 8/1972 | Ebata | 112/235 |
| 3,993,009 | 11/1976 | Osaki | 112/235 |
| 4,063,524 | 12/1977 | Ochiai | 112/152 |

*Primary Examiner*—H. Hampton Hunter
*Attorney, Agent, or Firm*—O'Brien and Marks

[57] ABSTRACT

An apparatus for sewing a slide fastener chain to a pair of article panels separates the chain into separate stringers which are sewn to the article panels with the fastening elements facing outward. The slide fastener stringers are twisted and the inner edges of the attached article panels are folded and the stringers are reinterlocked by a turning and pull-up device through which the slide fastener stringers with attached article panels are pulled by a pulling mechanism.

3 Claims, 5 Drawing Figures

FIG. 1
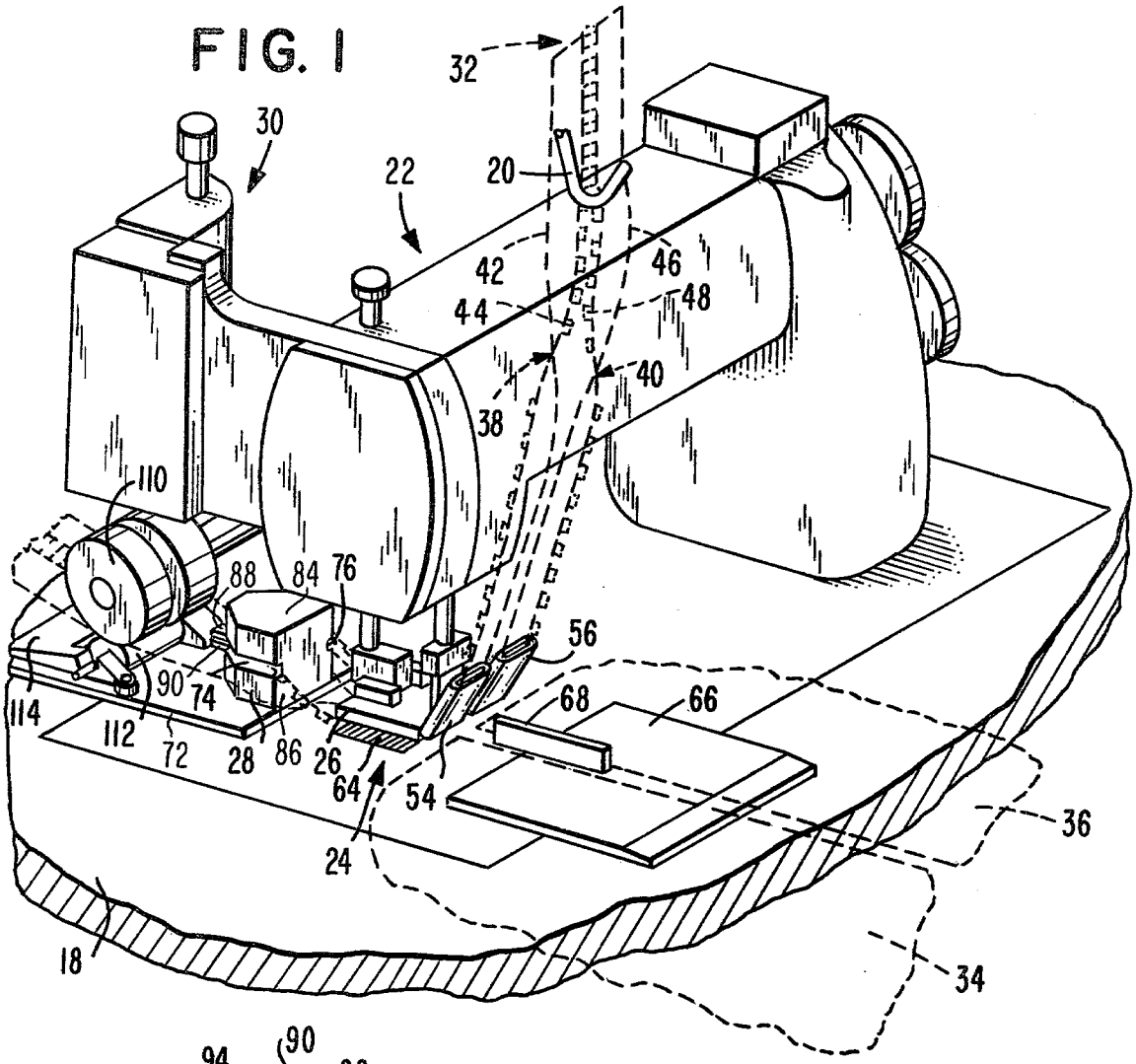
FIG. 2
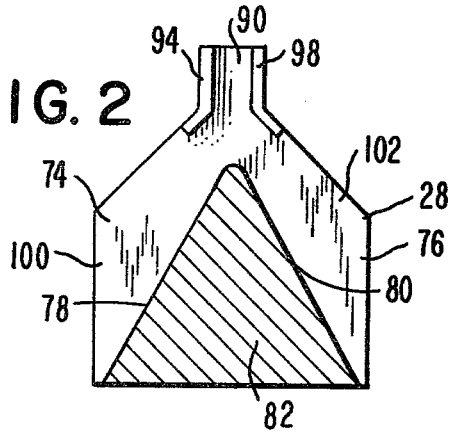
FIG. 3
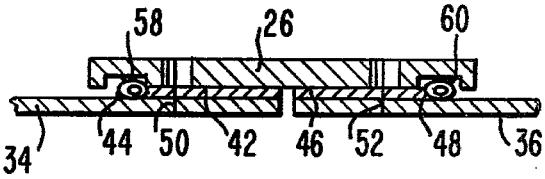
FIG. 4
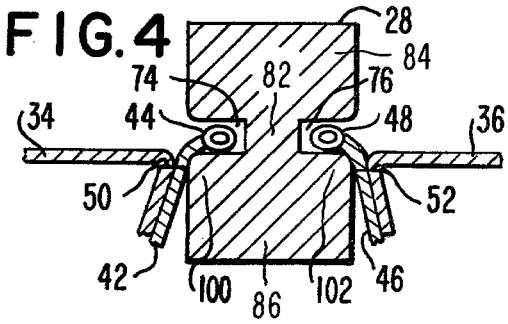
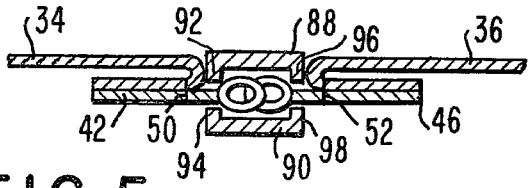
FIG. 5

APPARATUS FOR SEWING SLIDE FASTENER CHAIN TO ARTICLE PANELS

TECHNICAL FIELD

The invention relates to apparatus for sewing slide fastener chains to articles and particularly to such apparatus wherein the slide fastener chain is first split into two separate stringers which are turned so that the fastening elements are facing outward.

DESCRIPTION OF THE PRIOR ART

The prior art, as exemplified in U.S. Pat. Nos. 3,318,273 and 4,063,524, contains apparatus and techniques for splitting a zipper chain into two stringers, turning or twisting the stringers so that their fastening elements face outward, and sewing the separated stringers to respective article portions or panels. The stringers with attached article panels are manually turned back so that the fastening elements face inward, the turning back including folding the article panels at the stitch lines. The turned-back stringers are manually aligned and reclosed or pulled-up. Such manual turning-back, folding, realigning and pulling up involves substantial labor.

SUMMARY OF THE INVENTION

The invention is summarized in an apparatus for sewing a slide fastener chain to a pair of article panels wherein the slide fastener chain has a pair of tapes and a pair of interlocking rows of fastening elements mounted on inner edges of the respective tapes, each tape together with each corresponding row of fastening elements defining a stringer, the apparatus including means for disengaging the pair of rows of fastening elements to separate the stringers, a dual needle sewing machine having a sewing station for sewing the separated stringers to the respective article panels by respective lines of stitches, the dual needle sewing machine including presser foot means for guiding the pair of separated stringers through the sewing station with the inner tape edges and the fastening elements being turned to the outside and with the outer tape edges being turned to the inside and aligned relative to inner edges of the respective article panels, a turning and pull-up device positioned behind the sewing station, the turning and pull-up device including turning means for turning the separated stringers so that the inner tape edges and the fastening elements are reoriented to the inside and for folding inner edge portions of the article panels along the lines of stitches, the turning and pull-up device also including pull-up means for re-interlocking the fastening elements of the stringers after the separated stringers have been turned, and a chain pulling mechanism operated by the sewing machine for pulling the slide fastener chain with attached and folded article panels from the turning and pull-up device.

An object of the invention is to substantially reduce labor costs in sewing of slide fasteners to articles.

Another object of the invention is to construct an apparatus for separating the stringers of a slide fastener chain, sewing the separated stringers to article panels, and reclosing the stringers.

An advantage of the invention is that reclosing of the separated stringers with attached article portions occurs simultaneously with the sewing of the article portions to the separated slide fastener stringers.

One feature of the invention is the provision of a single turning and pull-up device for turning separated slide fastener stringers and folding attached article portions as the stringers are pulled up.

Other objects, advantages and features of the invention will be apparent from the following description of the preferred embodiment taken in conjunction with the accompanying drawings.

BRIEF DESCRIPTION OF THE DRAWINGS

FIG. 1 is a perspective view of an apparatus constructed in accordance with the invention.

FIG. 2 is a section view, the section being taken along a horizontal plane, of a turning and pull-up device of the apparatus of FIG. 1.

FIG. 3 is a cross-section view of the sole of a presser foot together with separated slide fastener stringers and article portions being sewn in the apparatus of FIG. 1.

FIG. 4 is an elevational sectional view of a turning portion of the turning and pull-up device of FIG. 1 with separated slide fastener stringers and attached article portions shown in cross section.

FIG. 5 is an elevational sectional view of a pull-up portion of the turning and pull-up device of FIG. 1 with a slide fastener chain and attached article portions.

DESCRIPTION OF THE PREFERRED EMBODIMENT

As shown in FIG. 1, the invention is embodied in an apparatus supported on a table top 18 and including a slide fastener separating device such as a hook 20, a sewing machine indicated generally at 22 having a sewing station indicated generally at 24 with a presser foot 26, a turning and pull-up device 28, and a pulling mechanism indicated generally at 30. The apparatus is used for sewing a slide fastener chain indicated generally at 32 to a pair of article portions or panels 34 and 36.

The slide fastener chain 32 consists of a pair of stringers indicated generally at 38 and 40. The stringer 38 is formed by a tape 42 and a row of fastening elements 44 mounted on the inner edge of the tape 42, while the stringer 40 is formed by a tape 46 and a row of fastening elements 48 mounted on the inner edge of the tape 46. The fastening elements 44 and 48 may be protruding convolutions of conventional coil fasteners or may be any other type of fastening elements mounted on inner edges of tapes for being opened and closed by movement of a slider (not shown). The article portions 34 and 36 may be cloth, vinyl, etc. portions of a garment or any other article being manufactured to include a slide fastener.

The slide fastener chain splitting or separating device 20 is a conventional device which is mounted in a suitable manner, for example, on supporting structure for a reel (not shown) for supplying the slide fastener chain 32 to the apparatus.

The sewing machine 22 is a conventional dual needle sewing machine for sewing a pair of straight lines of stitches 50 and 52, FIG. 3, to attach the tapes 42 and 46 to the respective article panels 34 and 36. A pair of tubular guides 54 and 56 are mounted on the front of the presser foot 26 and are formed to have elongated narrow passages therethrough for receiving and guiding the stringers 38 and 40, after the stringers 38 and 40 have been turned or twisted through 180 degrees to orient the fastening elements 44 and 48 to the outside, to the presser foot 26 which has grooves 58 and 60 for receiving and guiding the coupling elements 44 and 48 through the sewing station 24. The sewing machine 22 has a feed dog 64 for cooperating with the presser foot 26 to advance the inner edge portions of the panels 34 and 36 and the stringers 38 and 40 through the sewing station in a conventional manner.

A plate 66 with an upstanding guiding rib 68 is mounted in front of the sewing station 24 for aiding an operator in guiding the panels 34 and 36 to the sewing station 24.

The turning and pull-up device 28, FIGS. 1, 2, 4 and 5, is mounted on top of a plate 72 secured at the rear of the sewing station 24 and includes a pair of slots 74 and 76 formed in the opposite sides thereof for receiving the respective fastening elements 44 and 48 and inner portions of the tapes 42 and 46. The inner edges of the slots 74 and 76 are defined by walls 78 and 80 of a triangular connecting portion or post 82 joining upper and lower portions 84 and 86 of the device 28 which are above and below the slots 74 and 76, respectively. The walls 78 and 80 converge at an apex of the triangular post 82 converging the slots 78 and 80 at the rear end or pull-up portion of the device 28 which includes a pair of upper and lower rear extensions 88 and 90 extending from the respective upper and lower portions 84 and 86. Flanges 92 and 94 extend toward each other from left edges of the respective upper and lower extensions 88 and 90 and from rear sections of the respective upper and lower portions 84 and 86, and flanges 96 and 98 extend toward each other from right edges of the respective upper and lower extensions 88 and 90 and from rear sections of the respective upper and lower portions 84 and 86. The portions of the flanges 92, 94, 96 and 98, on the upper and lower extensions 88 and 90 extend parallel to each other, and the portions of the flanges 92, 94, 96 and 98 on the upper and lower portions 84 and 86 flare outwardly toward the front. The flanges 92, 94, 96 and 98 are spaced and cooperate with each other and the apex of the post 82 to form a Y-shaped channel (shown inverted in FIG. 2) suitable for engaging and guiding the fastening elements 44 and 48 to reinterlock the fastening elements. The front portion or turning portion of the device 28 has lower outward extending portions 100 and 102 for engaging the tapes 42 and 46 to turn the stringers back as well as to fold the inner edge portions of the article panels 34 and 36 at the stitch lines 50 and 52. The front turning portion is positioned relative to the rear pull-up portion so that the flanges 92, 94, 96 and 98 also serve to hold the fastening elements 44 and 48 and inner portions of the tapes 42 and 46 in the slots 74 and 76 as well as providing the force to the stringers 38 and 40 counteractive to the twisting and folding force imparted to the stringers by the portions 100 and 102 of the device 28.

The pulling mechanism 30 is a conventional pulling device such as that manufactured by Joseph's Puller Company, Massachusetts, USA, and includes a wheel 110 which is driven by a suitable mechanism connected to the sewing machine 22 to operate at a speed to pull the chain 32 at a rate equal to the rate of advancement by the feed dog 64. The wheel 110 cooperates with a roller 112 rotatably mounted on a bearing support 114 mounted on the plate 72 to grip the slide fastener chain 32 and pull the slide fastener chain with the attached article panels 34 and 36 through the turning and pull-up device 20.

In operation of the apparatus of FIGS. 1–5, an operator positions article panels 34 and 36 on the plate 66 with the inner edges of the panels 34 and 36 adjacent to the guiding ridge 68 and the front edges of the presser foot 26 generally in allignment with the turned-in outer edges of the slide fastener tapes 42 and 46. The sewing machine 22 is then operated to sew the article panels 34 and 36 to the tapes 42 and 46 of the slide fastener chain 32.

The slide fastener chain 32 is split by the device 20 into separate stringers 38 and 40 which are twisted 180° so that the fastening elements 44 and 48 face outward as the stringers 38 and 40 are fed to the guide members 54 and 56 and the presser foot 26. The feed dog 64 and presser foot 26 operate to feed the article panels 34 and 36 and the slide fastener stringers 38 and 40 through the sewing station 24 where straight lines of stitches 50 and 52 are formed by the sewing machine 22 to attach the tapes 42 and 46 of the slide fastener stringers to the article panels 34 and 36.

After exiting from the presser foot 26, the slide fastener stringers 38 and 40 with attached article panels 34 and 36 are pulled through the turning and pull-up device 28 by the pulling mechanism 30. The fastening elements 44 and 48 of the slide fastener stringers are engaged by the flanges 92, 94, 96 and 98 of the pull-up portion of the device 28 to retain the inner edges of the stringers supporting the fastening elements in the slots 74 and 76 of the pull-up device 28. The extending lower portions 100 and 102 of the pull-up device engage the tapes 42 and 46 of the stringer to twist the stringers 180° as well as to fold the inner edge portions of the article panels 34 and 36 about the stitching lines 50 and 52. The flanges 92, 94, 96 and 98 engaging the fastening elements 44 and 48 also bring about convergence of the fastening elements and interlocking thereof within the Y-shaped channel formed by the flanges 92, 94, 96 and 98 and the apex of the post 82.

The present invention results in a substantial saving in labor since manual procedures employed for turning back the slide fastener stringers, folding the inner edges portions of the article panels, reinterlocking the fastening elements are eliminated or substantially reduced.

Since many variations, modifications and changes in detail may be made to the above described embodiment, it is intended that all matter in the foregoing description and shown in the accompanying drawings be interpreted as illustrative and not in a limiting sense.

What is claimed is:

1. An apparatus for sewing a slide fastener chain to a pair of article panels wherein the slide fastener chain has a pair of tapes and a pair of interlocking rows of fastening elements mounted on inner edges of the respective tapes, each tape together with each corresponding row of fastening elements defining a stringer, the apparatus comprising means for disengaging the pair of rows of fastening elements to separate the stringers, a dual needle sewing machine having a sewing station for sewing the tapes of the separated stringers to the respective article panels by respective lines of stitches, said dual needle sewing machine including presser foot means for guiding the pair of separated stringers through the sewing station with the inner tape edges and the fastening elements being turned to the outside and with the outer tape edges being turned to the inside and aligned relative to inner edges of the respective article panels, a turning and pull-up device positioned behind the sewing station, said turning and pull-up device including turning means for turning the separated stringers so that the inner tape edges and the fastening elements are reoriented to the inside and for folding inner edge portions of the article panels along the lines of stitches, said turning and pull-up device also including pull-up means for reinterlocking the fastening elements of the stringers after the separated stringers have been turned, and a chain pulling mechanism operated by the sewing machine for pulling the slide fastener chain with attached and folded article panels from the turning and pull-up device.

2. An apparatus as claimed in claim 1 wherein the turning and pull-up device includes a forward portion defining the turning means, a rearward portion defining the pull-up means, the turning and pull-up device has a pair of horizontal slots formed in opposite side thereof and extending through both the forward and rearward portions for receiving the fastening elements and inner tape edges of the respective stringers, the turning and pull-up device has inner walls defining inner edges of the slots and which converge from the forward portion of the device to a point at the rearward portion, flanges on the rearward portion which with the inner walls define a Y-shaped channel for engaging the fastening elements to reinterlock the fastening elements, and shoulder means on the forward portion defining outer edges of the slots and extending horizontally for engaging the tapes of the stringers to turn the stringers and fold the inner edge portions of the article panels.

3. An apparatus as claimed in claim 1 or 2 wherein the sewing machine includes feed-dog means for advancing the article panels and stringers through the sewing station, and the chain pulling mechanism includes wheel means driven by the sewing machine for pulling the slide fastener chain with attached and folded article panels from the turning and pull-up device.

* * * * *